US005464465A

United States Patent [19]

Avotins et al.

[11] Patent Number: 5,464,465

[45] Date of Patent: Nov. 7, 1995

[54] FIBER BONDED AGGLOMERATED ORE MATERIALS

[75] Inventors: Peter V. Avotins, Easton; Robert E. Evans, Huntington, both of Conn.

[73] Assignee: Cytec Technology Corp., Wilmington, Del.

[21] Appl. No.: 300,680

[22] Filed: Sep. 2, 1994

Related U.S. Application Data

[62] Division of Ser. No. 149,870, Nov. 10, 1993, Pat. No. 5,372,632.

[51] Int. Cl.[6] ..... C22B 1/244

[52] U.S. Cl. ..... 75/313; 75/321; 75/324; 75/325

[58] Field of Search ..... 75/313, 321, 324, 75/325

[56] References Cited

U.S. PATENT DOCUMENTS 3,765,869 10/1973 Schierloh et al. .

5,211,920 5/1993 Polizzotti ..... 75/772

FOREIGN PATENT DOCUMENTS 1002761 1/1977 Canada .
8002566 11/1980 WIPO .

OTHER PUBLICATIONS

"Blast Furnace Ironmaking" vol. Two; McMaster Univ. Ontario,Canada May 1992, pp. 9–9 through 9–13.

*Primary Examiner*—Melvyn Andrews
*Attorney, Agent, or Firm*—F. M. Van Riet

[57] ABSTRACT

Process for producing agglomerates, e.g., by pelletizing a particulate inorganic material for example an ore material, characterized by the addition to the agglomerated material of an organic fibrous material, especially a polyacrylonitrile fiber material, to bind and thereby enhance the properties of the agglomerates and recovery of metal values therefrom.

11 Claims, No Drawings

FIBER BONDED AGGLOMERATED ORE MATERIALS

This is a divisional of application(s) Ser. No. 08/149,870 filed on Nov. 10, 1993, now U.S. Pat. No. 5,372,632.

This invention relates to a process for bonding agglomerates of particles of preferably inorganic materials. The invention is characterized by the inclusion into the agglomerates of fibers, namely of organic polymeric materials, particularly polymers comprising acrylonitrile.

BACKGROUND OF THE INVENTION

The use of fibers as a binder for agglomerates can be practiced for a plurality of particle types, especially of inorganic materials, particularly ores and ore concentrates, such as iron ores, e.g. hematite, magnetite or other iron oxide materials comprising one or more of the oxides FeO, $Fe_3O_4$ and $Fe_2O_3$ as well as other iron oxide materials, such as hydrated oxides, etc. See, for example, Canadian Patent No. 1,002,761, Jan. 4, 1977.

Other suitable agglomeratable materials are ores of nickel, cobalt, copper, zinc, lead, tungsten, etc. as well as other materials in agglomerated form, e.g. catalyst materials or carriers for catalyst materials, such as alumina.

Agglomeration methods of various types may be used, preferably rolling of particled materials into pellets in devices comprising drums, cones or discs.

Agglomeration by rolling to pellets is usually performed with the addition of a liquid, preferably water or an aqueous solution of organic or inorganic materials. It is also possible to include other binders which are commonly used for agglomeration, such as organic binders of various types especially polymeric materials, such as cellulose and cellulose derivatives, starch materials, curable resins, etc., and inorganic additives, such as bentonite or other clays, lime, cement, such as Portland cement, slag cement, alumina cement etc. The use of inorganic materials, such as bentonite, is widely practiced in producing pellets of iron ore, but: bentonite is known to add silica and alumina and thereby contaminates the concentrate. To compensate, the ore has to be upgraded more than is usually necessary, based on the specification of the final pellet composition, thus representing an additional cost and a source of variability in pellet chemistry. Organic binders avoid this contamination, but are often too expensive or commercially unavailable. Inorganic fibrous materials such as glasswool fibers, rockwool fibers slagwool and the like have been proposed, see, for example, World Patent No 80/02566, Nov. 27, 1980, but, in spite of their low cost, have been found difficult to handle and to generally cause environmental problems. Organic polymeric materials, both natural and synthetic, such as cellulose pulp, wool fibers, rayon fibers, nylon fibers, and the like, have been used, see, for example, the above-mentioned Canadian Patent No. 1,002,761, but the quantity of the fibers exemplified, e.g., 1% by weight (20 lbs/ton) based on the ore makes, them too expensive to be a commercially attractive replacement for the inorganics. Another factor to be considered is the desirability of using a binder which does not chemically affect the reduction process normally used in converting ores to metal values. Bentonite and other clays render the pellets acidic and interfere with direct reduction. Organic binders, on the other hand, do not lead to such interference. In the present state of the art, it is therefore desirable to provide organic binders, but only those effective at low concentrations, in order to produce pellets or other agglomerates which overcome the disadvantages of the prior art. It has been found that such agglomerates are produced if specific fibrous polymers comprising units derived from acrylonitrile are used as binders.

SUMMARY OF THE INVENTION

In accordance with the present invention, there is provided a process for producing agglomerates comprising pellets, briquettes, and the like, the process comprising A. providing a mixture of:

(i) one or more particulate inorganic materials, selected from an ore, an ore concentrate, a mineral concentrate, or a mixture thereo; and (ii) an effective, bindings amount of one or more fibrous materials at least one of which comprises a monocomponent or bicomponent pulp or fiber of a polymer containing acrylonitrile in a quantity of more than 35 wt %, said fiber having a diameter of less than 100 microns, a length greater than 0.2 mm, and a minimum aspect ratio in the range of 20–50; and B. converting the mixture produced in A. into agglomerates by rolling pellets, pressing briquettes, or the like, thereby forming fiber-bearing agglomerates of improved properties relative to those of similar agglomerates devoid of fibers.

In preferred features, the invention contemplates a process as above defined wherein the particulate inorganic material agglomerated comprises an ore or a concentrate of iron, nickel, cobalt, copper, zinc, lead, tungsten, chromium, aluminum, manganese, vanadium, uranium, tin, antimony, bismuth, silver or gold, or a mixture of any of the foregoing; preferably one in which iron ore or iron oxide is agglomerated. Also a preferred feature of the invention is a process, as above defined, wherein the acrylic fibers are comprised of a polymer containing acrylonitrile in a quantity of more than 85 wt %; that wherein the agglomerated ore material comprises oxidic, sulphidic or hydroxidic ore material selected from an ore material comprising one or more of iron, nickel, cobalt, copper, zinc, lead, tungsten, chromium, aluminum, manganese, vanadium, uranium, tin, antimony, bismuth, silver or gold; and that wherein the preferred quantity of fibers is from about 0.01 to about 10% by weight based on the total weight of A.(i) and (ii). More preferable, is that process wherein the quantity of fibers is from about 0.05 to about 1%, by weight, based on the total weight of A.(i) and (ii); and that process wherein the fibers are admixed with the particulate inorganic material in an aqueous dispersion, and the process also includes the step A.1 of removing some or all of the water before forming the material into agglomerates; and that process which includes the step B.1 of firing the agglomerates so as to improve their crush resistance and impact strength. Special mention is made of a futher preferred process of the invention wherein the fibers comprise acrylic fibers which: (1) are fibrillated, at least 50 % of the fibers have a thickness of between 0.1 and 20 microns, and a length of up to 50 ram, or (2) are unfibrillated fibers with a diameter of less than 20 microns and a length up to about 20 mm.

DETAILED DESCRIPTION OF THE INVENTION

The grain size of the material to be agglomerated may vary within broad limits, e.g. from about 0.001 mm to about 1 mm, preferably from about 0.01 to about 0.5 mm. Finer or coarser materials may, however, be included in the agglomerates, preferably at minimum concentrations.

The term "acrylic fibers", as Used herein and in the appended claims, includes fibers obtained by the wet-spinning, dry-spinning, flash-spinning, air gap-spinning, etc., of homopolymers of acrylonitrile, or copolymers containing at least 85% by weight of acrylonitrile, the remainder being an ethylenically unsaturated comonomer copolymerizable with acrylonitrile, or blends of polymers wherein the total content of polymerized acrylonitrile is higher than 85%, by weight. The term also includes "modacrylic fibers" which are copolymers comprising from 35 to 85%, by weight, of polymerized acrylonitrile.

The fiber diameter is required to be small, i.e., preferably less than 20, and more preferably less than 13, micrometers and especially preferably the fibers will have an average diameter in the range of about 5–13 micrometers. It is necessary that the fibers have a minimum length in the preferred range of 0.5–3 millimeters, and a preferred maximum length of about 20 millimeters. A most important characteristic is the aspect ratio, i.e. length divided by diameter (L/D). It has been found that aspect ratios must be no less than about 20–50, and preferably substantially higher, e.g. above about 100, up to about 300. The aspect ratio can be increased by using smaller diameter fibers, or longer fibers with larger diameter fibers. The best balance of properties has been found to be achieved with fibers of about 5 to about 13 micrometer diameters and lengths between about 0.5 and about 30 millimeters.

The concentration of the polyacrylonitrile fiber binders may be maintained within the normally used ranges or may be decreased, e.g. less than 50 or 20% or even less of the quantities normally used.

The expression "fibers" when used in relation to this invention is intended to include elongated bodies having an extension in the longitudinal direction of at least 20, preferably at least 100, times the extension in any other direction perpendicular thereto. The cross sectional shape perpendicular to the longitudinal direction may vary depending upon the method of production but is preferably about circular or with a ratio largest diameter:smallest diameter in the cross section, of less than 5:1, preferably less than 3:1 and especially preferably less than 2:1.

The quantity of fibers in the agglomerates preferably is less than or up to 20%, by weight, of the agglomerate, preferably less than 2%, by weight, and especially preferably about 1 to about 0.01%, by weight, based on the solid materials volume of the agglomerate particles and the fibers.

The fibers may be added entirely or partly to the starting material which is subjected to agglomeration, e.g. rolling (bailing), e.g. added to an aqueous suspension or pulp of particles prior to dewatering, e.g. fine iron ore particles prior to dewatering, after grinding or benefication or optionally in the benefication step. Fibers added to an aqueous suspension of particles may facilitate the removing of liquid, e.g. dewatering of an aqueous suspension of an ore concentrate. The fibers may also be added entirely or partly prior to or during the agglomeration step, especially rolling to balls (balling).

For the agglomeration of ores, especially iron ores, it is preferable to use a fiber composition which makes it possible to omit slag forming constituents e.g., kaolin, entirely or partly from the agglomerates or from the charge in which said agglomerates are included.

The present process finds substantial utility in the context of blast furnace ironmaking. The overall process has developed over the years and is well known. Reference is made to the literature for details, for example, to "Blast Furnace Ironmaking" Vol. Two, McMaster University, Ontario, Canada, May 1992, pages 9-1 to 9-59, and particularly to the discussion entitled "Production of Pellets", pages 9-9 to 9-13, and to the flow diagram on page 9-50, incorporated herein by reference.

In general, the production of iron ore pellets or balls consists of a sequence of operations involving the removal of ore from the ground, ore size reduction, ore upgrading, ore agglomeration to produce spherical pellets, and thermal induration of the resultant ore to impart the necessary physical and metallurgical properties thereto. Such techniques are well known to those skilled in this art and further detailed description is not necessary to the understanding of the present invention.

Recently, the development of fluxed pellets has been the most significant change in pelletizing practice in North America in recent years. It was found that although "acid" pellets, produced without the addition of limestone/dolomite fluxes, have good ambient and low temperature properties, their intermediate and high temperature properties are relatively poor. This is because at elevated temperatures, wustite combines with silicious gangue in the pellet, forming a low-melting fayalite which leads to a high contraction, low melting temperature, and a large softening-melting temperature range. The addition of appropriate fluxes to achieve a $CaO/SiO_2$ ratio of 0.9 to 1.2 with an MgO content of 1.5 to 2.0% yields a vast improvement in pellet properties. As a result, it becomes possible to achieve a more favorable cohesive zone configuration with fluxed pellets than with acid pellets. A number of blast furnace trials in North America have conclusively proven that significant productivity, hot metal composition, and fuel rate improvements can be achieved by using fluxed pellets. As a result, the production of fluxed pellets has been rapidly rising in North America.

Another related development has been the use of synthetic, organic binders to replace bentonite used in forming green pellets. The main justification appears to be a lower and less variable silica content in the pellets and improved reducibility in the case of acid pellets. However, the physical strength of these pellets appears to be weaker. Therefore, significant changes in indurating conditions and/or the addition of limestone are used as countermeasures. The growth of these organic binder-based, partially fluxed pellets has been very substantial. The relatively high cost of synthetic binders has, until the present invention, appeared to be a limiting factor in their wider application.

As examples of furnaces in which products according to the invention can be used, reference can be made to blast furnaces in which heat is involved by burning a fuel, electric blast furnaces, electric pigiron furnaces, optionally with prereduction (such as prereduction in a rotating furnace or shaft furnace) low shaft furnaces, melt reduction furnaces, LD-converters and other furnaces operating with injection of oxygen or other oxidizing gases, optionally in combination with or together with protective gases, such as argon, water vapor, hydrocarbons etc, injected against the surface of the charge and/or through nozzles arranged under the level of the melt, especially in the furnace bottom. Examples thereof are the caldo furnace and the dored furnace.

As examples of other minerals which can be treated in the process according to the invention reference may, in addition to the materials mentioned above, also be made to ores and minerals comprising chromium, aluminum, manganese, vanadium, uranium, tin, antimony, bismuth, silver and gold.

The process according to the invention is especially suited also for the production of chromium by a process which comprises the preparation of agglomerates from various kinds of chromium ores, e.g. by ball rolling (bailing, pelletizing) or briquetting, comprising fibers according to the invention in the quantities mentioned above, e.g. the Cobond-process comprising autoclave leaching at about 200° C.

The addition of fibers according to the invention can also be used for all the materials and minerals stated above in a dewatering step, e.g. by filtration i.e. using suction filters and similar devices, when forming the agglomerates, e.g. by ball rolling (balling, pelletizing) or briquetting, e.g. in briquetting presses or by extrusion, the fiber material being included homogeneously or in layers in various manners, as disclosed above. The inclusion of a fiber material may also be used for facilitating processes comprising contact with a liquid, such as leaching minerals from the ores stated above or removing unwanted constituents or for recovering dissolvable desired constituents, e.g. by leaching with acid or basic compounds, optionally after a preceding heat treatment, such as oxidation or reduction by heating in an oxidizing or reducing environment.

When using fibers in agglomerates of iron ore and also in other agglomerated products, it is, for commercial reasons, suitable to reduce the content of fibers, preferably to less than 2 or 1%, by volume, especially to not above 0.5 or optionally not above 0.25%, by volume, and most especially to less than 0.1%, by volume, said contents being related to the real dry volume of solid materials.

As stated previously, the polyacrylonitrile fibers may be combined with other measures or means for bonding agglomerates, such as bonding by heating to high temperatures, e.g., by heating to above 500° C., in which case it is often possible to reduce the bonding temperature compared with the temperature normally used for bonding the same agglomerates without fibers.

Other bonding methods in which the addition of polyacrylonitrile fibers may beneficially be used are hydrothermal bonding comprising a hydrothermal reaction especially at temperatures up to 200° to 600° C. with constituents in the agglomerated material and/or the fibers. Furthermore, hydraulic binders, e.g. cement, such as portland cement, may be combined with the addition of acrylonitrile polymer fibers according to the invention, e.g. using the type and amounts of binders used in the so called "Grangcold" method. Suitable contents , e.g. for preparing iron compound agglomerates are about 0.01 to about 5%, by weight, of fibers and about 1 to about 20%, by weight, of e.g. cement based on the total weight of the agglomerate.

DESCRIPTION OF THE PREFERRED EMBODIMENTS

The invention is further illustrated in the following examples. The asterisk (*) designates comparative examples. All parts are by weight unless otherwise specified.

EXAMPLE 1

An agglomerate composition is prepared, in accordance with the present invention, by mixing for 10 minutes in a PK mixer, 15 parts of iron ore concentrate with a basicity or (Ca, MgO):SiO of 0.9, a moisture content of 8.70%, and an average particle size of 80% minus 500 Mesh with 12.5 parts of water that contains enough CFF® 110-1 fibrillated fiber, a commercially available acrylonitrile polymer fiber, to produce a composition that has approximately 2 parts of the polymer fibers per net 2240 parts of iron ore concentrate. The resulting mixture is vacuum filtered to a moisture content of approximately 9.13% and broken up through a 6 mesh screen.

Prior to mixing the aqueous solution with the iron ore concentrate, the aqueous fiber suspension is mixed in a Waring blender for approximately 10 seconds to predisperse the fibers.

The mixture is bench balled to produce –½"+7/16" pellets. The green ball strength and fired properties are tested by standard procedures. In the data column headings, of the tables below, the legends and abbreviations have the following meanings:

A. Bench Bailing—Summarized results of observations on the ability to form green balls, including the amount of water required and the surface appearance of the balls, i.e., whether or not there is surface moisture, which is undesirable, and whether the surface is smooth, which is desirable.

B. 18" W.K.—Wet pellet drop is a measure of the ability to maintain integrity following dropping from an 18" height; the higher the number of drops, the better.

C. ⅜" Crush lbs.—A measure of the green strength of unfired pellets measured when wet (W.C.) and when dry (W.D.), the higher the number, the better.

D. %+¼—A measure of the abrasion resistance of fired pellets which is determined by screening fines before tumbling (B.T.) and comparing them with fines produced after tumbling (A.T.). "Q" INDEX—is the quotient of A.T. over B.T., the higher the value of "Q", the better.

E. A.T. %-30M—The amount of fines produced during tumbling the fired pellets; the lower the number, the better.

F. Crush(lbs)—The crush strength of the fired pellets; the higher the number the better.

G. Canadran Standard Freehess (CSF)—A characteristic of the degree of the fibrillation of the fiber and not of the pellets.

The test results for this Example 1 are reported in Table 1, below.

EXAMPLE 2

An agglomerate composition is prepared, in accordance with the present invention, by the procedure outlined in Example 1 except that the iron ore concentrate has a moisture content of 8.70% and the concentration of acrylonitrile fibrillated fibers in the aqueous solution is enough to produce a composition that has approximately 8 parts of the fibrillated fibers per 2240 parts of iron ore concentrate. The resulting mixture is vacuum filtered to a moisture content of approximately 9.14% and broken up through a 6 mesh screen.

The mixture is bench balled to produce –1/2"+7/16" pellets that are tested according to the procedures outlined in Example 1 and the results of the are reported in Table 1.

COMPARATIVE EXAMPLE 1*

An agglomerate composition, not in accordance with the present invention, is prepared by mixing for 10 minutes in a PK mixer, 15 parts of iron ore concentrate that has a basicity or (Ca, MgO):SiO of 0.9, a moisture content of 10.87% and an average particle size of 80% minus 500 Mesh with enough bentonite to produce a composition that has approximately 18 parts of bentonite per 2240 parts of iron ore concentrate. The resulting mixture is vacuum filtered to a moisture content of approximately 10.43% and broken up through a 6 mesh screen.

The mixture is bench balled to produce $-^{1/2"+7/16"}$ pellets that are tested according to the procedures outlined in Example 1 and the results are reported in Table 1, below.

TABLE 1

| Example | Bench Balling | 18" W.K. | 3/8" Crush lbs W.C. | 3/8" Crush lbs D.C. | % + ¼ A.T. | "Q" INDEX | A.T. %-30M | Crush (lbs) |
|---|---|---|---|---|---|---|---|---|
| 1 | Good;Good Surface | 3.2 | 2.0 | 1.9 | 96.92 | 96.79 | 2.92 | 549 |
| 2 | Good;Good Surface | 4.0 | 2.2 | 2.5 | 97.69 | 97.56 | 2.15 | 547 |
| 1* | Good;Good Surface | 8.7 | 2.9 | 6.1 | 98.62 | 98.55 | 1.23 | 633 |

The results reported in Table 1 show that agglomerates made in accordance with the present invention provide good bench balls, produce green balls with good surface and handling characteristics and provide good fired pellet physical quality. They are equivalent in these respects to much higher levels of bentonite, the state of the art binder.

EXAMPLE 3

An agglomerate composition is prepared, in accordance with the present invention, by mixing for 10 minutes in a PK mixer 15 parts of iron ore concentrate that has a basicity or (Ca, MgO):SiO of 0.9, a moisture content of 8.70% and an average particle size of 80%—500 Mesh with enough of an aqueous solution containing 28.8 percent by weight of a commercially available fibrillated acrylonitrile polymer fiber (CFF® 114-3) with a CSF of 60 ml to produce a composition that has approximately 2 parts of the polymer fibers per 2240 parts of iron ore concentrate. The resulting mixture is vacuum filtered to a moisture content of approximately 9.30% and broken up through a 6 mesh screen.

Prior to mixing the aqueous solution with the iron ore concentrate, the aqueous solution is mixed in a Waring blender for approximately 10 seconds to predisperse the fibers in the solution.

The mixture is bench balled to produce $-^{1/2"+7/16"}$ pellets that are tested according to, the procedure outline in Example 1 with the exception that the %+¼ before tumbling (B.T.) is also determined by screening the pellets on a ¼" screen. The results of the tests are reported in Table 2.

COMPARATIVE EXAMPLE 2*

A bentonite-bonded agglomerate is prepared, not in accordance with the present invention, by the procedure outlined in Comparative Example 1* except that the iron ore concentrate has a moisture content of 10.70%. The resulting mixture is vacuum filtered to a moisture content of approximately 10.06% and broken up through a 6 mesh screen.

The mixture is bench balled to produce $-^{1/2"+7/16"}$ pellets that are tested according to the procedure outlined in Example 3 and the results of the are reported in Table 2, below.

EXAMPLE 4

An agglomerate composition is prepared, in accordance with the present invention, by the procedure outlined in Example 3 except that the iron ore concentrate has a moisture content of 8.10% and enough of an aqueous solution containing 27.3, percent, by weight, of a commercially available fibrillated acrylonitrile polymer fiber having a CSF of 250 ml, sold under the trademark CFF® 111-3 fibrillated fiber, is mixed with the iron ore concentrate to produce a composition that has approximately 2 parts of the polymer fibers per 2240 parts of iron ore concentrate. The resulting mixture is vacuum filtered to a moisture content of approximately 9.03% and broken up through a 6 mesh screen.

The mixture is bench balled to produce $-^{1/2"+7/16"}$ pellets that are tested according to the procedure outlined in Example 3 and the results of the are reported in Table 2, below.

EXAMPLE 5

An agglomerate composition is prepared, in accordance with the present invention, by the procedure outlined in Example 3 except that the iron ore concentrate has a moisture content of 9.30% and enough of an aqueous solution containing 28.8 percent, by weight, of a fibrillated acrylonitrile fiber with a CSF of 404 ml and a length of 6 mm is mixed with the iron ore concentrate to produce a composition that has approximately 2 parts of the polymer fibers per 2240 parts of iron ore concentrate. The resulting mixture is vacuum filtered to a moisture content of approximately 9.16% and broken up through a 6 mesh screen.

The mixture is bench balled to produce $-^{1/2"+7/16"}$ pellets that are tested according to the procedure outlined in Example 3 and the results of the are reported in Table 2, below.

EXAMPLE 6

An agglomerate composition is prepared, in accordance with the present invention, by the procedure outlined in Example 3 except that the iron ore concentrate has a moisture content of 9.00% and enough of an aqueous solution containing 5.6 percent, by weight, of a fibrillated acrylonitrile fiber with a CSF of 30 ml and a length of 3 mm is mixed with the iron ore concentrate to produce a composition that has approximately 2 parts of the polymer fibers per 2240 parts of iron Ore concentrate. The resulting mixture is vacuum filtered to a moisture content of approximately 9.30% and broken up through a 6 mesh screen.

The mixture is bench balled to produce $-^{1/2"+7/16"}$ pellets that are tested according to! the procedure outlined in Example 3 and the results of the are reported in Table 2, below.

EXAMPLE 7

An agglomerate composition is prepared in accordance with the present invention, according to the procedure outlined in Example 3 except that the iron ore concentrate has a moisture content of 8.60% and enough of an aqueous solution containing approximately 5% of a commercially available, non-fibrillated, 0.8 microdenier acrylonitrile polymer comprising chopped short fibers, 1.5 mm in length, sold under the tradename CTF® 311 Technical Fiber, is mixed with the iron ore concentrate to produce a composition that has approximately 2 parts of the polymer fibers per 2240 parts of iron ore concentrate. The resulting mixture is vacuum filtered to a moisture content of approximately 9.13% and broken up through a 6 mesh screen.

The mixture is bench balled to produce $-1/2''+7/16''$ pellets that provide test data reported in Table 2, below.

TABLE 2

| Example | Bench Balling | 18" W.K. | ⅜" Crush lbs W.C. | ⅜" Crush lbs D.C. | % + ¼ B.T. | % + ¼ A.T. | "Q" INDEX | A.T. %-30M | Crush (lbs) | Fiber Freeness (CSF) (ml) |
|---|---|---|---|---|---|---|---|---|---|---|
| 3 | Excellent[a] | 3.3 | 1.7 | 1.6 | 99.74 | 99.15 | 95.90 | 3.69 | 483 | 60 |
| 2* | Good | 7.7 | 2.5 | 7.6 | 99.93 | 99.62 | 98.55 | 1.38 | 619 | — |
| 4 | Excellent[a] | 3.7 | 1.9 | 2.0 | 99.87 | 99.85 | 95.73 | 3.85 | 582 | 250 |
| 5 | Excellent[a] | 4.2 | 1.8 | 2.0 | 99.86 | 98.00 | 97.80 | 1.69 | 560 | 404 |
| 6 | Excellent[a] | 4.3 | 2.0 | 2.0 | 99.87 | 98.31 | 98.18 | 1.38 | 554 | 30 |
| 7 | Excellent[a] | 3.8 | 2.1 | 2.4 | 99.82 | 96.62 | 96.43 | 3.23 | 486 | 0.8 micro denier |

[a]No surface moisture

All the compositions reported in Table 2 exhibit good balling and no surface moisture. Example 4 requires a lot of water for balling while Example 5 requires very little water. All the agglomerates made in accordance with the present invention, Examples 3–7, exhibit excellent fiber dispersion.

The results reported in Table 2 indicate that the agglomerates made in accordance with the present invention, Examples 3–7, exhibit good fired pellet attrition and crush strength with no clear trend in physical properties of the agglomerates based on freeness of the fibers.

EXAMPLE 8

An agglomerate composition is prepared, in accordance with the present invention, by the procedure outlined in Example 7 except that the iron ore concentrate has a moisture content of 8.96% The resulting mixture with approximately 2 parts of non-fibrillated microdenier acrylonitrile fibers per 2240 parts of iron ore concentrate, is vacuum filtered to a moisture content of approximately 8.58% and broken up through a 6 mesh screen.

The mixture is bench balled to produce $-1/2''+7/16''$ pellets that are tested according to the procedure outlined in Example 3 and the results of the are reported in Table 3, below.

COMPARATIVE EXAMPLE 3*

An agglomerate composition is prepared, not in accordance with the present invention by the procedure outlined in Comparative Example 1 except that the iron ore concentrate has a moisture content of 9.41%. The resulting mixture with approximately 18 parts of bentonite per 2240 parts of iron ore concentrate, is vacuum filtered to a moisture content of approximately 9.98% and broken up through a 6 mesh screen.

The mixture is bench balled to produce $-1/2''+7/16''$ pellets that are tested according to the procedure outlined in Example 3 and the results of the are reported in Table 3, below.

EXAMPLE 9

An agglomerate composition is prepared, in accordance with the present invention, by the procedure outlined in Example 7, except that the iron ore concentrate has a moisture content of 7.81% and enough of the aqueous solution used Example 7 is mixed with the iron ore concentrate to produce a composition that has approximately 1 part of the microdenier fibers per 2240 parts of iron ore concentrate. The resulting mixture is vacuum filtered to a moisture content of approximately 8.62% and broken up through a 6 mesh screen.

The mixture is bench balled to produce $-1/2''+7/16''$ pellets that are tested according to the procedure outlined in Example 3 and the results of the are reported in Table 3, below.

EXAMPLE 10

An agglomerate composition is prepared, in accordance with the present invention, by the procedure outlined in Example 7 except that the iron ore concentrate has a moisture content of 8.30% and enough of the aqueous solution used in Example 7 is mixed with the iron ore concentrate to produce a composition that has approximately 1 part of the microdenier fibers per 2240 parts of iron ore concentrate.

After the fiber and iron ore concentrate are mixed, a powered organic binder commercially available under the tradename SF N 300, is added thereto prior to mixing in the PK mixer. The resulting mixture has 1.0 part of organic binder per 2240 parts of iron ore concentrate.

The resulting mixture is vacuum filtered to a moisture content of approximately 9.53% and broken up through a 6 mesh screen.

The mixture is bench balled to produce $-1/2''+7/16''$ pellets that are tested according to the procedure outlined in Example 3 and the results of the are reported in Table 3, below.

EXAMPLE 11

An agglomerate composition is prepared, in accordance with the present invention, by the procedure outlined in Example 10 except that the iron ore concentrate has a moisture content of 7.80%, enough of the aqueous solution used in Example 7 is mixed with the iron ore concentrate to produce a composition that has approximately 1 part of the microdenier fibers per 2240 parts of iron ore concentrate and enough of the powered organic binder used in Example 10, is mixed with the iron ore concentrate and acrylonitrile fiber mixture to produce a composition that has 0.2 part of organic binder per 2240 parts of iron ore concentrate.

The resulting mixture is vacuum filtered to a moisture content of approximately 9.02% and broken up through a 6 mesh screen.

The mixture is bench balled to produce $-^{1/2"+7/16"}$ pellets that are tested according to the procedure outlined in Example 3 and the results of the are reported in Table 3, below.

COMPARATIVE EXAMPLE 4*

An agglomerate composition is prepared not in accordance with the present invention by mixing for 10 minutes in a PK mixer, 15 parts of iron ore concentrate that has a basicity or (Ca, MgO):SiO of 0.9, a moisture content of 10.60%, and an average particle size of 80%— 500M with enough of the organic binder of Example 11 to produce a mixture that has 2.0 part of organic binder per 2240 parts of iron ore concentrate.

The resulting mixture is vacuum filtered to a moisture content of approximately 11.68% and broken up through a 6 mesh screen.

The mixture is bench balled to produce $-^{1/2"+7/16"}$ pellets that are tested according to the procedure outlined in Example 3 and the results of the are reported in Table 3, below.

EXAMPLE 12

An agglomerate composition is prepared, in accordance with the present invention, by the procedure outlined in Example 10 except that the iron ore concentrate has a moisture content of 8.10%, enough of the aqueous solution used in Example 7 is mixed with the iron ore concentrate to produce a composition that has approximately 1 part of polyacrylonitrile microdenier fibers per 2240 parts of iron ore concentrate and enough of a powered carboxymethyl cellulose organic binder commercially available under the tradename Peridur® 330, is mixed with the iron ore concentrate and fiber mixture to produce a composition that has 1.0 part of organic binder per 2240 parts of iron ore concentrate.

The resulting mixture is vacuum filtered to a moisture content of approximately 9.71% and broken up through a 6 mesh screen. The mixture is bench balled to produce $-^{1/2"+7/16"}$ pellets that are tested according to the procedure outlined in Example 3 and the results of the are reported in Table 3, below.

EXAMPLE 13

An agglomerate composition is prepared, in accordance with the present invention, by the procedure outlined in Example 12 except that the iron ore concentrate has a moisture content of 8.89%, enough of the aqueous solution used in Example 7 is mixed with the iron ore concentrate to produce a composition that has approximately 1 part of the microdenier fibers per 2240 parts of iron ore concentrate and enough of the powered organic binder used in Example 12 is mixed with the iron ore concentrate and fiber mixture to produce a composition that has 0.2 part of organic binder per 2240 parts of iron ore concentrate.

The resulting mixture is vacuum filtered to a moisture content of approximately 9.16% and broken up through a 6 mesh screen.

The mixture is bench balled to produce $-^{1/2"+7/16"}$ pellets that are tested according to the procedure outlined in Example 3 and the results of the are reported in Table 3, below.

EXAMPLE 14

An agglomerate composition is prepared, in accordance with the present invention, by mixing for 10 minutes in a PK mixer, 15 parts of iron ore concentrate that has a basicity or (Ca, MgO):SiO of 0.9, a moisture content of 8.61% and an average particle size of 80% —500M with enough of an aqueous solution containing approximately 5% of a non-fibrillated, microdenier acrylonitrile polymer fiber, commercially available under the tradename CTF 311 Technical Fiber to produce a composition that has approximately 2 parts of the polymer fibers per 2240 parts of iron ore concentrate. The resulting mixture is vacuum filtered to a moisture content of approximately 8.93% and broken up through a 6 mesh screen.

The mixture is bench balled to produce $-^{1/2"+7/16"}$ pellets that are tested according to the procedure outlined in Example 3 and the results of the are reported in Table 3, below.

TABLE 3

| | Binder (parts) | | | 18" | ⅜" Crush lbs | | % + ¼" | % + ¼" | "Q" | A.T. | Crush |
|---|---|---|---|---|---|---|---|---|---|---|---|
| Example | Fiber | Powder | Bench Balling | W.K. | W.C. | D.C. | B.T. | A.T. | INDEX | %-30M | (lbs) |
| 4* | 2.0 | — | Good/good surf. | 5.1 | 3.3 | 3.1 | 99.14 | 97.38 | 96.54 | 2.15 | 485 |
| 3* | — | — | Good/good surf. | 6.7 | 2.5 | 9.2 | 99.87 | 98.31 | 98.18 | 1.38 | 448 |
| 9 | 1.0 | — | Slow/good surf. | 4.2 | 2.7 | 2.3 | 97.87 | 96.31 | 94.26 | 2.92 | 478 |
| 10 | 1.0 | 1.0 | Slow/good surf. | 5.9 | 2.7 | 3.5 | 99.87 | 98.31 | 98.18 | 1.38 | 488 |
| 11 | 1.0 | 0.2 | Good/good surf. | 3.2 | 2.1 | 2.1 | 99.60 | 98.46 | 98.07 | 1.23 | 486 |
| 8* | — | 2.0 | Good/good surf. | 21.3 | 2.3 | 6.8 | — | 96.00 | 95.88 | 3.85 | 500 |
| 12 | 1.0 | — | Good/good surf. | 4.7 | 2.5 | 3.2 | 99.53 | 98.15 | 98.08 | 1.54 | 474 |
| 13 | 1.0 | 0.2 | Good/good surf. | 4.8 | 2.5 | 2.1 | 98.87 | 98.15 | 97.04 | 1.69 | 514 |
| 14 | 2.0 | — | Good/good surf. | 4.2 | 2.8 | 2.5 | 99.40 | 97.23 | 96.65 | 2.15 | 487 |

surf. = surface

All the agglomerates in of Examples 8–14 exhibited good balling (two were slow, but still acceptable) and good surface characteristics.

The results of Table 3 indicate that the addition of an organic binder to an acrylonitrile fiber/iron ore mixture is not necessary to substantially enhance the agglomerate properties that are formed in accordance with the present invention.

EXAMPLE 15

The procedure of Example 9 is again followed except that a mixture of polyacrylonitrilie 0.8 microdenier fibers of a fiber length of 0.5, 1.0 and 1.5 mm (⅓ of each by weight) is used in place of the fiber thereof. The iron ore concentrate has a Moisture Content of 10.15%. The resultant pellets have a Moisture Content of 9.32% an 18" W.K. of 4.4 and a ⅜" Crush (lbs), W.C. of 2.1 and D.C. of 1.8. Balling is good and the surface is wet.

EXAMPLE 16

The procedure of Example 15 is again followed except that the fibers are added in a quantity of ⅓ each by number and the moisture content of the ore is 10.31%. The resultant pellets have a Moisture Content of 9.34%, an 18" W.K. of 4.4, and a ⅜" Crush (lbs), W.C. of 2.1 and D.C. of 1.8. Balling is fair to good and the surface is wet.

EXAMPLES 17–30

Following the procedure of Example 3, except modified as indicated, pellets are prepared using various concentrations and types of binders, alone or in conjunction with others, from a similar iron ore concentrate. The results are set forth in Table 4, below.

In all samples containing fiber, the green balls are held together by the fibers when the balls are dry crushed.

TABLE 4

| | Binder (parts) | | | | | % of Moisture Conc. with | Green | Green Ball physicals | | | |
|---|---|---|---|---|---|---|---|---|---|---|---|
| | | | | | | | | | ⅜" Crush - lbs | | Comments |
| Example | A | B | C | D | E | Additive | Ball | 18" W.K. | W.C. | D.C. | Balling |
| 17 | 0 | 0 | 2 | 0 | 0 | 8.10 | 9.19 | 9.4 | 3.0 | 4.4 | good |
| 18 | 4 | 1 | 0 | 0 | 0 | 7.90 | 9.16 | 5.1 | 2.2 | 3.6 | good |
| 19C* | 2 | 0 | 0 | 0 | 0 | 9.09 | 9.64 | 3.6 | 1.5 | 1.6 | good |
| 20C* | 4 | 0 | 0 | 0 | 0 | 9.14 | 9.53 | 4.0 | 1.6 | 2.0 | good |
| 21 | 4 | 0 | 1 | 0 | 0 | 8.36 | 9.25 | 6.8 | 2.4 | 4.3 | good |
| 22 | 0 | 0 | 1 | 0 | 1 | 8.97 | 9.51 | 8.7 | 2.4 | 3.3 | good |
| 23 | 2 | 0 | 1 | 0 | 0 | 7.70 | 8.95 | 6.5 | 2.3 | 3.6 | good |
| 24 | 0 | 1 | 0 | 0 | 0 | 7.66 | 8.79 | 4.7 | 2.2 | 2.7 | good |
| 25 | 2 | 0 | 2 | 0 | 0 | 7.97 | 8.82 | 11.5 | 4.0 | 5.4 | good |
| 26C* | 18 | 0 | 0 | 0 | 0 | 8.84 | 10.14 | 7.2 | 2.2 | 7.2 | good |
| 27 | 2 | 1 | 0 | 0 | 0 | 8.49 | 8.98 | 4.8 | 2.4 | 3.6 | good |
| 28 | 0 | 0 | 1 | 1 | 0 | 8.37 | 9.88 | 10.0 | 2.6 | 4.7 | good |
| 29 | 4 | 0 | 2 | 0 | 0 | 8.50 | 8.98 | 10.0 | 3.6 | 5.6 | good |
| 30 | 0 | 1 | 0 | 0 | 0 | 8.80 | 9.15 | 7.3 | 2.4 | 2.9 | good |

C* = Comparative
A = bentonite
B = non-fibrillated, acrylonitrile polymer fiber, 13 mm in diameter and 3 mm long
C = non-fibrillated, acrylonitrile polymer fiber, 13 mm in diameter and 6 mm long
D = carboxymethyl cellulose
E = polyacrylamide The above mentioned patents, publications and test methods are incorporated herein by reference.

Many variations in the present invention will suggest themselves to those skilled in the art in light of the above detailed description. For example, instead of an acrylic fiber containing more than 85% of acrylonitrile units, a modacrylic copolymer of vinyl chloride and acrylonitrile containing 85% of acrylonitrile units can be used. Instead of removing part of the water before forming the material into agglomerates, all of the water can be used. Instead of rolling pellets from the compositions, briquettes can be pressed from them. Other normally used additives, such as paper fibers, rock wool fibers, peat moss, starch, dextrin, coke breeze, and the like, can be present in the compositions, so long as the acrylonitrile polymer fiber functions as the primary binder. All such obvious modifications are within tile full intended scope of the appended claims.

We claim:

1. The product produced by the process comprising

A. providing a mixture of:

(i) one or more particulate inorganic materials, selected from an ore, an ore concentrate, a mineral concentrate, or a mixture thereof; and (ii) an effective, binding amount of one or more fibrous materials at least one of which comprises a monocomponent or bicomponent pulp or fiber of a polymer containing acrylonitrile in a quantity of more than 35 wt %, said fiber having a diameter less than about 100 microns, a length greater than about 0.2 mm, and a minimum aspect ratio in the range of about 20–50; and B. converting the mixture produced in A. into agglomerates whereby said agglomerates have improved properties relative to those of similar agglomerates devoid of fibers.

2. A product according to claim 1 wherein the particulate inorganic material agglomerated comprises an ore or a concentrate of a metal selected from the group consisting of ion, nickel, cobalt, copper, zinc, lead, tungsten, chromium, aluminum, manganese, vanadium, uranium, tin, antimony, bismuth silver, golf and a mixture of any of the foregoing.

3. A product according to claim 2 wherein iron ore or iron oxide is agglomerated.

4. A product according to claim 1, wherein said acrylic fibers are comprised of a polymer containing acrylonitrile in a quantity of more than 85 wt %.

5. A product according to claim 2 wherein the ore is selected from the group consisting of oxidic, sulphidic and hydroxidic ore and the concentrate material is selected from the group consisting of one or more of iron, nickel, cobalt, copper, zinc, lead, tungsten, chromium, aluminum, manganese, vanadium, uranium, tin, antimony, bismuth, silver and gold.

6. A product according to claim 1 wherein the quantity of fibers is from about 0.01 to about 10 %, by weight based on the total weight of A.(i) and (ii).

7. A product according to claim 6 wherein the quantity of fibers is from about 0.05 to about 1 % by weight, based on the total weight of A.(i) and (ii).

8. A product according to claim 1 wherein the fibers are admixed with the particulate inorganic material in an aqueous dispersion, and the process includes the additional step A (iii) of removing some or all of the water before forming the material into agglomerates.

9. A product according to claim 8, wherein the process includes the additional step B (i) of firing the agglomerates so as to improve their crush resistance and impact strength.

10. A product according to claim 1 wherein said fibers comprise acrylic fibers which: (1) are fibrillated, at least 50% of the fibers having a thickness of between 0.1 and 20 microns, and a length of up to 50 mm, or (2) are unfibrillated fibers with a diameter of less than 20 microns and a length up to about 20 mm.

11. A product according to claim 1 wherein said fibers comprise primarily acrylic fibers, and the balance of the fibers are selected from the group consisting of paper fibers, rock wool fibers, peat moss, starch, dextrin, coke breeze, and a mixture of any of the foregoing.

* * * * *